US006858564B2

(12) United States Patent
Halbrook, Jr. et al.

(10) Patent No.: US 6,858,564 B2
(45) Date of Patent: Feb. 22, 2005

(54) THERMAL PAPER WITH PREPRINTED INDICIA

(75) Inventors: Wendell B. Halbrook, Jr., Waynesville, OH (US); Mary Ann Wehr, Hamilton, OH (US)

(73) Assignee: NCR Corporation, Dayton, OH (US)

( * ) Notice: Subject to any disclaimer, the term of this patent is extended or adjusted under 35 U.S.C. 154(b) by 0 days.

(21) Appl. No.: 10/823,635

(22) Filed: Apr. 14, 2004

(65) Prior Publication Data

US 2004/0198600 A1 Oct. 7, 2004

Related U.S. Application Data

(63) Continuation of application No. 10/036,725, filed on Dec. 21, 2001, now Pat. No. 6,803,344.

(51) Int. Cl.[7] ..... B41M 5/30
(52) U.S. Cl. ..... 503/206; 503/200; 503/226
(58) Field of Search ..... 503/200, 206, 503/226

(56) References Cited

U.S. PATENT DOCUMENTS

| | | | |
|---|---|---|---|
| 2,800,457 | A | 7/1957 | Green et al. |
| 3,016,308 | A | 1/1962 | Macaulay |
| 3,116,206 | A | 12/1963 | Brynko et al. |
| 3,167,602 | A | 1/1965 | Bentov et al. |
| 3,202,533 | A | 8/1965 | Sachsel et al. |
| 3,429,827 | A | 2/1969 | Ruus |
| 4,150,997 | A | 4/1979 | Hayes |
| 4,153,593 | A | 5/1979 | Zabiak et al. |
| 4,328,332 | A | 5/1982 | Hayes et al. |
| 4,370,370 | A | 1/1983 | Iwata et al. |
| 4,388,362 | A | 6/1983 | Iwata et al. |
| 4,424,245 | A | 1/1984 | Maruta et al. |
| 4,425,161 | A | 1/1984 | Shibahashi et al. |
| 4,444,819 | A | 4/1984 | Maruta et al. |
| 4,507,669 | A | 3/1985 | Sakamoto et al. |
| 4,551,738 | A | 11/1985 | Maruta et al. |
| 4,604,635 | A | 8/1986 | Wiklof et al. |
| 4,740,495 | A | 4/1988 | Marinelli et al. |
| 5,155,230 | A | 10/1992 | Hibino et al. |
| 5,158,924 | A | 10/1992 | Konagaya et al. |
| 5,177,218 | A | 1/1993 | Fischer et al. |
| 5,206,395 | A | 4/1993 | Fischer et al. |
| 5,266,447 | A | 11/1993 | Takahashi et al. |
| 5,292,855 | A | 3/1994 | Krutak et al. |
| 5,336,714 | A | 8/1994 | Krutak et al. |
| 5,384,077 | A | 1/1995 | Knowles |
| 5,405,958 | A | 4/1995 | VanGemert |
| 5,407,885 | A | 4/1995 | Fischer et al. |
| 5,423,432 | A | 6/1995 | Krutak et al. |
| 5,427,414 | A | 6/1995 | Fletcher et al. |
| 5,427,415 | A | 6/1995 | Chang |
| 5,429,774 | A | 7/1995 | Kumar |
| 5,446,151 | A | 8/1995 | Rickwood et al. |
| 5,500,040 | A | 3/1996 | Fujinami |
| 5,583,223 | A | 12/1996 | Fischer et al. |
| 5,595,955 | A | 1/1997 | Chang et al. |
| 5,690,857 | A | 11/1997 | Osterried et al. |
| 5,826,915 | A | 10/1998 | Gregory, Jr. |
| 5,843,864 | A | 12/1998 | Popp et al. |
| 5,883,043 | A | 3/1999 | Halbrook, Jr. et al. |
| 6,048,347 | A | 4/2000 | Erdman |
| 6,060,426 | A | 5/2000 | Tan et al. |
| 6,060,428 | A | 5/2000 | Chang et al. |
| 6,165,937 | A | 12/2000 | Puckett et al. |

FOREIGN PATENT DOCUMENTS

| | | |
|---|---|---|
| GB | 989264 | 4/1965 |
| WO | WO 00 16986 A | 3/2000 |
| WO | WO 01/09435 A1 | 2/2001 |

*Primary Examiner*—Bruce H. Hess
(74) *Attorney, Agent, or Firm*—Millen White Zelano & Branigan PC

(57) ABSTRACT

Thermosensitive recording materials such as thermal paper have printed indicia of high quality on the back thereof printed on a backcoating. This backcoating also incorporates an optically variable compound which provides a security feature.

16 Claims, No Drawings

THERMAL PAPER WITH PREPRINTED INDICIA

This application is a continuation of U.S. Ser. No. 10/036,725, filed Dec. 21, 2001, now U.S. Pat. No. 6,803, 344.

FIELD OF THE INVENTION

The present invention relates to thermosensitive recording materials with high quality images preprinted thereon.

BACKGROUND OF THE INVENTION

Direct thermal paper is a thermosensitive recording material on which print or a design is obtained without an ink ribbon by the application of heat energy thereto. Direct thermal paper comprises a base sheet, a base coating and a thermosensitive coating with color forming chemicals that respond to heat.

The most common type of thermosensitive coating used on direct paper is the dye-developing type system. This typically comprises a colorless dye (color former), a bisphenol or an acidic material (color developer) and sensitizer. These solid materials are reduced to very small particles by grinding and incorporated into a coating formulation along with any optional additives such as pigments, binders and lubricants. The coating formulation is then applied to the surface of a support system, typically a base sheet and base coating. The color is formed by application of heat to the thermosensitive coating to melt and interact the three color producing materials.

Thermal printing on thermosensitive recording materials provides a number of advantages over printing on plain paper using inked ribbons. One advantage is that thermal printers are less noisy than impact printers. With fewer mechanical operations, thermal printers are believed to be more reliable than impact printers. There are some compromises which must be made when switching from bond paper to thermal paper because the color producing components require special handling and conditions.

To replace plain paper receipt rolls, it is often desirable that the thermal paper also provides security features and preprinted information such as store logos, advertisements, rules and regulations, etc. It is also desirable that this preprinted indicia be of high quality.

By adding features to thermal paper, care must be taken not to pre-react the reactive components within the thermosensitive coating of the thermal paper or prevent the formation of an image on the thermal paper when passed through a thermal printer. Certain chemical factors can adversely affect and degrade the performance of the thermosensitive coatings and should be avoided such as some organic solvents, plasticizers, amines and certain oils.

The use of ink with optically variable compounds as a security measure is well known. Optically variable compounds change color or reflect a unique wavelength in response to a change in ambient conditions such as exposure to a light source other than ambient light or a change in ambient temperature. Optically variable compounds as defined herein include fluorescent compounds and photochromic compounds which respond to infrared or ultraviolet light, thermochromic compounds which change color at different temperatures and near infrared fluorescent (NIRF) compounds which reflect radiation in the near-infrared range. Examples of fluorescent compounds include those described in U.S. Pat. Nos. 4,153,593, 4,328,332 and 4,150, 997. Examples of thermochromic compounds are described in U.S. Pat. Nos. 4,425,161; 5,427,415; 5,500,040; 5,583, 223; 5,595,955; 5,690,857; 5,826,915; 6,048,347; and 6,060,428. Examples of near infra-red compounds (NIRF) include those described in U.S. Pat. Nos. 5,292,855; 5,423, 432 and 5,336,714. The use of fluorescent compounds as a security feature for thermosensitive recording materials is described in U.S. Pat. No. 5,883,043. The use of NIRF compounds as a security feature for thermosensitive recording materials is described in U.S. Pat. No. 6,060,426, assigned to the assignee as the present invention.

To protect thermal paper from environment conditions, and premature coloration from handling, a number of developments have been made. One is to produce a barrier or protection on top of the thermal coating as disclosed in U.S. Pat. Nos. 4,370,370; 4,388,362; 4,424,245; 4,44,819; 4,507, 669 and 4,551,738. A U.V. cured silicone acrylate/methacrylate protective coating for a thermosensitive layer is described in U.S. Pat. No. 4,604,635.

U.S. Pat. No. 5,595,955 discloses coating a latent image comprising a thermochromic ink on the reverse side of thermal paper with a thin protective layer.

SUMMARY OF THE INVENTION

The present invention provides a thermosensitive recording material such as thermal paper, comprising a base sheet, an optional base coating, a thermosensitive coating on the top surface of the base sheet or the optional base coating, a backcoating on the side of the base sheet opposite the thermosensitive coating and a printed image on the top surface of the backcoating. The backcoating has incorporated therein a fluorescent compound, a thermochromic compound, a photochromic compound, or a near infrared fluorescent compound (NIRF).

When used as a security feature, the amount of NIRF compound within the backcoating must be sufficient to be sensed by a photon detector operating in the near infrared region of 650 nm to 2500 nm. For a photochromic or fluorescent compound to provide a security feature, the amount of these compounds within the backcoating must be sufficient to generate a latent image when exposed to infrared or ultraviolet light. To provide a security feature, the amount of thermochromic compound within the backcoating must be sufficient to generate or eliminate an image when exposed to temperatures greater than ambient temperature.

The backcoating containing the fluorescent compound, photochromic compound, thermochromic compound and/or NIRF compound can be a U.V., infrared or electron beam cured coating or an air dried coating such as a flexographic or lithographic coating. The backcoating is preferably U.V. cured. This will eliminate the exposure of reactive components within the thermosensitive coating to heat which can cause the reactive components to prematurely color. The backcoat provides a medium in which the optically variable compounds will provide their security function while shielding the reactive components of the thermosensitive coatings from these optically variable compounds. This shielding will preserve the activity of the optically variable compounds as well as the activity of any reactive components within the thermosensitive coating of the thermal paper so that the thermosensitive coating will still generate color when exposed to heat.

In certain embodiments, two or more optically variable compounds can be present in the backcoating to provide two modes of security. For example, optically variable compounds responsive to ultraviolet light can be combined with NIRF compounds which are responsive to near-infrared radiation. In alternative embodiments, the backcoating can overcoat a separate image of a security ink. This requires an additional printing step and is not preferred.

The backcoating can be applied by conventional coating processes such as flexography, gravure, wet-offset printing, letter press and relief printing and where necessary cured by air drying or U.V., infrared or electron beam curing techniques. Following the cure of the backcoating, an image is printed over the backcoating by conventional printing techniques such as flexography, gravure, wet-offset printing, letter press and relief printing.

The thermosensitive recording media of the present invention have a base sheet and a thermosensitive coating positioned on one side of the base sheet. Optionally, a base coating is positioned between the thermosensitive coating and the base sheet. Conventional base sheets and base coatings can be used in the thermosensitive recording materials of the present invention. The base sheet can comprise those materials used in conventional thermosensitive recording materials and at least includes those derived from synthetic and natural fibers such as cellulose (natural) and polyester (synthetic) fibers. The base coating is typically comprised of an inert pigments and binders and provides a smooth surface for the thermosensitive coating. The base sheet and base coatings must not contain any reactive elements which will prematurely color the thermosensitive coating or cause the loss of the color forming properties of the thermosensitive coating.

The thermosensitive coating is preferably of the dye-developing type. Particularly suitable dye developer systems are those wherein the reactive dyes are colorless or white colored and become dark colored when melted or exposed to color developer. Such dyes typically are basic substances which become colored when oxidized by acidic compounds or bisphenol compounds. In these dye-developer systems, sensitizers are typically mixed with the dyes to form a blend with a reduced melting point. This reduces the amount of heat necessary to melt the dye and obtain reaction with the color developer. The components of the thermosensitive coating are often determined by the operating temperature of the thermal printer to be used. The operating temperature of conventional thermal printers varies widely, typically within the range of from 50° C. to 250° C. A well-known dye that operates in this range is identified in the art as "ODB-II". A preferred color developer is bisphenol A and a preferred sensitizer is M-terphenyl. One skilled in the art can readily determine the melting point necessary for desired application and select a dye and developer accordingly, or select a conventional thermal paper with a thermosensitive coating on one side.

The thermosensitive coating can vary in composition as is conventionally known in the art, including the encapsulation of components therein and the use of protective layers thereon to prevent premature coloration during handling. These thermosensitive coatings can be applied by conventional methods using conventional equipment.

Color formers suitable for use in the coating formulations that form the thermosensitive recording materials of this invention are leuco dyes. Leuco dyes are colorless or light-colored basic substances, which become colored when oxidized by acidic substances. Examples of leuco dyes that can be used herein are leuco bases of triphenylmethane dyes represented by formula I in U.S. Pat. No. 5,741,592. Specific examples of such dyes are: 3,3-bis(p-dimethylaminophenyl)-phthalide, 3,3-bis(p-dimethylaminophenyl)-6-dimethylaminophthalide (Crystal Violet Lactone), 3,3-bis(p-dimethylaminophenyl)-6-diethylaminophthalide, 3,3-bis(p-dimethylaminophenyl)-6-chlorophthalide, and 3,3-bis(p-dibutylaminophenyl)-phthalide.

Leuco bases of floran dyes represented by formula II in U.S. Pat. No. 5,741,592, are also suitable. Some examples of these fluoran dyes are:

3-cyclohexylamino-6-chlorofluoran, 3-(N-N-diethylamino)-5-methyl-7-(N-N-Dibenzylamino)fluoran, 3-dimethylamino-5,7-dimethylfluoran and 3-diethylamino-7-methylfluoran. Other suitable fluoran dyes include: 3-diethylamino-6-methyl-7-chlorofluoran, 3-pyrrolidino-6-methyl-7-anilinofluoran, and 2-[3,6-bis(diethylamino)-9-(0-chloroanilino)xanthylbenzoic acid lactam].

Also suitable are lactone compounds represented by formula III in U.S. Pat. No. 5,741,592 and the following compounds:

3-(2'-hydroxy-4'-dimethylaminophenyl)-3-(2'[-methoxy-5'-chlorophenyl)phthalide, 3-(2'-hydroxy-4'-dimethylaminophenyl)-3-(2'-methoxy-5'-nitrophenyl-phthalide, 3-(2'-hydroxy-4'-diethylamninophenyl)-3-(2'-methoxy-5'-methylphenyl)phthalide, and 3-(2'-methoxy-4'-dimethylaminophenyl)-3-(2'-hydroxy-4'-diethylaminophenhl)-3-(2'-methoxy-5'-methylphenyl) phthalide, and 3-(2'-methoxy-4'-dimethylaminophenyl)-3-(2'-hydroxy-4'-chloro-5'-methylphenyl)-phthalide.

There are many substances which change the color of the dyes by oxidizing them and function as developers. Color developers suitable for the coating formulations and thermosensitive recording materials of this invention are phenol compounds, organic acids or metal salts thereof and hydroxybenzoic acid esters. Preferred color developers are phenol compounds and organic acids which melt at about 50° C. to 250° C. and are sparingly soluble in water. Examples of suitable phenol compounds include 4,4'-isopropylene-diphenol (bisphenol A), p-tert-butylphenol, 2-4-dinitrophenol, 3,4-dichlorophenol, p-phenylphenol, 4,4-cyclohexylidenediphenol, 2,2-bis(4'-hydroxyphenyl)-n-heptane and 4,4'-cylcohexylidene phenol. Useful examples of organic acid and metal salts thereof include 3-tert-butylsalicyclic acid, 3,5-tert-butylsalicyclic acid, 5-a-methylbenzylsalicylic acid and salts thereof of zinc, lead, aluminum, magnesium or nickel.

Sensitizers or thermosensitivity promoter agents are preferably used in the thermal papers of the present invention to give a good color density. The exact mechanism by which the sensitizer helps in the color forming reaction is not well known. It is generally believed that the sensitizer forms a eutectic compound with one or both of the color forming compounds. This brings down the melting point of these compounds and thus helps the color forming reaction take place at a considerably lower temperature. Some of the common sensitizers which are suitable are fatty acid amide compounds such as acetamide, stearic acid amide, linolenic acid amide, lauric acid amide, myristic acid amide, methylol compounds or the above mentioned fatty acid amides such as methylene-bis(stearamide), and ethylene-bis(stearamide), and compounds of p-hydroxybenzoic acid esters such as methyl p-hydroxybenzoate, n-propyl p-hydroxybenzoate, isopropyl p-hydroxybenzoate, benzyl p-hydroxybenzoate.

The backcoating for printing on the reverse side of thermosensitive recording medium preferably has a thickness of from 0.05 to 2.0 mils. It should be recognized however that higher thicknesses will not affect the chemical activity of the thermosensitive coating on the thermosensitive recording media In addition, higher thicknesses will not affect the ability of the backcoating to accept print. The above range is preferred from the standpoint of cost and efficiency.

Flexographic and lithographic printing methods are preferred for applying the backcoating on the thermosensitive recording medium. Other suitable techniques include gravure, letter press and relief printing which does not require temperatures above 50° to 65° C. Once applied the backcoating preferably does not require temperatures in excess of 125° F. (about 50° C.) to cure. The backcoat can vary significantly from a U.V. or visible light cured polymer coating to an electron beam cured polymer coating, to a heat cured polymer coating cured at temperatures of up to 125° F., to a condensed polymer coating which dries at ambient temperature in air. This backcoat serves to protect the thermosensitive layer from the optically variable compounds incorporated therein when the thermosensitive recording medium is stored on a continuous roll rolled onto itself or is stored as stacked sheets.

The backcoating may contain additives such as resins binders, pH stabilizers, U.V. stabilizers, surfactants, color pigments and defoamers provided they do not pre-react the thermosensitive layer. The nature of the additives will depend on the end use of the backcoating. Suitable binder components of the backcoating include: polyvinyl chloride polymers, polyvinyl acetate polymers, vinyl chloride-vinyl acetate copolymers, polyvinyl alcohol polymers, polyethylene polymers, polypropylene polymers, polyacetal polymers, ethylene-vinyl acetate copolymers, ethylene alkyl (meth)acrylate copolymers, ethylene-ethylacetate copolymers, polystyrene, styrene copolymers, polyamides, ethylcelluloses, epoxy resins, polyketone resins, polyurethane resins, polyvinyl butryl polymers, styrene butadiene rubbers, nitrile rubbers, acrylic rubbers, polypropylene rubber, ethylene alkyl(meth)acrylate copolymers, styrene-alkyl(meth)acrylate copolymers, acrylate acid-ethylene-vinyl acetate tert polymers, saturated polyester polymers and sucrose benzoate. To obtain emulsions of polymers which are insoluble or partially soluble, the resin is typically ground to submicron size. U.S. Pat. No. 5,843,864 describes some of the suitable synthetic resin binders and suitable cellulose binders with synthetic wax are described in U.S. Pat. No. 4,740,495.

Suitable U.V. cured backcoatings are the coatings described in U.S. Pat. No. 4,886,744. Most free radical initiated polymerizations can be suitably cured with the use of a free radical initiator that is responsive in the U.V. range. These U.V. cured backcoatings may also contain additives such as U.V. absorbers and light stabilizers. Employing the U.V. cured backcoating allows for rapid drying. U.S. Pat. No. 5,158,924 also describes ultraviolet curing resins which are suitable for backcoatings and include urethane resins, epoxy resins, organosiloxane resins, polyfunctional acrylate resins, melamine resins, thermoplastic resins having high softening points such as fluorine plastics, silicone resins and polycarbonate resins. A specific example of a urethane acrylate-type U.V. curing resin is UNIDIC C7-157 made by Dianippon Ink and Chemicals Inc.

The optically variable compound that can be incorporated within this coating can include fluorescent compounds, photochromic compounds, thermochromic compounds and NIRF compounds. The fluorescent compounds and photochromic compounds typically respond to infrared or ultraviolet light. Representative inks which fluoresce include those described in U.S. Pat. Nos. 4,153,593; 4,328,332 and 4,150,997. Representative photochromic compounds are disclosed by Takahashi et al. in U.S. Pat. No. 5,266,447.

Photochromic compounds which change color when exposed to U.V. light can be used. Suitable photochromic compounds include the spiro compounds of formula V disclosed by Takahashi in U.S. Pat. No. 5,266,447. These include spiro oxazine compounds, spiropyran compounds, and thiopyran compounds of the formulae in cols. 5–6 of U.S. Pat. No. 5,266,447. Other examples of suitable photochromic compounds include the benzopyran compounds disclosed by Kumar in U.S. Pat. No. 5,429,774, the benzothioxanone oxides disclosed by Fischer in U.S. Pat. No. 5,177,218 the dinitrated spiropyrans disclosed by Hibino et al. in U.S. Pat. No. 5,155,230, the naphthacenequinones disclosed by Fischer et al. in U.S. Pat. No. 5,206,395 and U.S. Pat. No. 5,407,885, the naphthopyran compounds disclosed by Knowles in U.S. Pat. No. 5,384,077, the Spiro (indoline) naphthoxazine compounds disclosed by VanGemert in U.S. Pat. No. 5,405,958, the ring compounds disclosed by Tanaka et al. in U.S. Pat. No. 5,106,988 and the spiro-benzoxazine compounds disclosed by Rickwood et al. in U.S. Pat. No. 5,446,151. Mixtures of such compounds are preferred and are available commercially from such sources as Color Change Corp. of Shaumburg, and Chromatic Technologies Inc. of Colorado Springs, Colo.

Suitable fluorescent pigments and dyes include the fluorescent resins produced in U.S. Pat. No. 4,328,332 from trimelitic anhydrides and propylene glycol with zinc acetate catalyst. Representative water soluble fluorescent dye components are fluorescein and cosine dyes and blaze orange 122-8524-A (manufactured by Dyco Color Corp. of Cleveland, Ohio).

The concentration of the fluorescent and/or photochromic pigment within the backcoating used on the thermal paper and method to this invention can vary widely. In general, the optical effect can be developed in most thermal papers with the fluorescent dye or photochromic pigment component present in an amount which ranges from 1 to 50% by weight and preferably in an amount of 1 to 15% by weight.

Suitable NIRF compounds are typically employed in polyester based and polyester amide based coatings. Examples of suitable NIRF compounds are described in U.S. Pat. Nos. 5,292,855; 5,423,432 and 5,336,714. Suitable NIRF compounds include pthalocyanines, napthalocyanines squaraines with are covalently bonded to halometals. NIRF compounds typically provide a security measure that is responsive to wavelengths in the near infrared region of 650 nm to 2500 nm. The NIRF pigment particles are solids and typically comprise a polymer or copolymer which is either admixed with NIRF compounds or the NIRF compounds are copolymerized with other active monomers, oligomers or polymers to form a copolymer. The amount of NIRF compound within the ink formulation typically falls within in the range of 0.1 ppm to 1000 ppm, based on dry components of the ink. Typical amounts fall within the range of 0.5 ppm to 300 ppm with amounts of 1 ppm to 100 ppm often being most preferred.

The thermochromic compounds suitable for use in the backcoating are selected to provide a security measure that is responsive to temperatures above ambient temperature (above 20° C.) and below the temperature of activation of the thermosensitive recording medium (typically about 60° C.). One class of preferred thermochromic compounds are active at temperatures in the range of 21° C. to 40° C., (about 70° F. to 100° F.). The compounds may be responsive to temperatures above this range but heating the thermosensitive recording medium to temperatures above this range will activate most conventional thermosensitive layers. One or more "sensitizers" may be added to the backcoating to control the temperature at which the color change occurs. Examples of suitable sensitizer compounds for the thermochromic compounds include carboxylic acids, acid amides, hydroxides, alcohols, esters and phenols. The thermochromic compounds are preferably stable to air, sunlight, and fluorescent light.

When a flexographic process is employed to deposit the backcoating, the thermochromic compounds are preferably soluble dispersible or emulsifiable in water to provide "water based" formulations or inks. When a lithographic process is employed to deposit the thermochromic compounds, it can be used in a hydrophobic or oil based formulation or ink, provided it is compatible with the backcoating. Water-based or U.V. cured formulations are preferred to avoid the use of solvents that may prereact the thermosensitive layer or cause the loss of color forming properties of the thermosensitive layer.

Preferred thermochromic compounds have excellent thermal stability with little light absorption in the visible light region, i.e., they impart little or no color to coatings and substrates to which they are applied. Preferably, they are transparent or invisible to the naked viewing eye under ambient light at ambient temperature (about 20° C.). Suitable thermochromic compositions include those described in U.S. Pat. Nos. 5,292,855; 5,423,432; 5,336,714; 5,461,136; 5,397,819; 5,703,229; 5,614,088; 5,665,151; 5,503,904; 4,425,161; 5,427,415; 5,500,040; 5,583,223; 5,959,955; 5,690,857; 5,826,915; 5,048,837 and 6,060,428. These include the conventional electron donors/electron accepting combinations known in the art. Examples of electron donor compounds are described in U.S. Pat. No. 4,425,161 and include diarylphthalides, such as crystal violet lactone, polyarylcarbinols, leucoauramines, Rhodamine B lactams, indolines, spiropyrans and fluorans. Examples of electron-acceptor compounds are also described in U.S. Pat. No. 4,425,161 and include triazol compounds, thioureas, phenols, phenol resins, benzolthiozols, carboxylic acids and metal salts thereof, and phosphorous esters and metal salts thereof.

Suitable commercially available thermochromic printing inks which activate at temperatures in the range of 21° to 51° C. include 744020TC (thermochromic blue), 744010TC (thermochromic turquoise), 744027TC (thermochromic yellow), 734010TC(thermochromic rose), 724010TC (thermochromic orange), 754027TC (thermochromic green) sold by SICPA Securink Corp. Springfield, Va. Included are the thermochromic inks which lose color when heated, i.e., change from a color to clear. This includes the compounds 138000TC5 (rose/clear) and 178002TC (Blue/clear) available from SICPA Securink Corp. which are active at 1° C.–12° C. Marks and images made of these compounds are colorless at ambient temperature and change color when cooled. The compound 178002TC (Black\clear) from SICPA Securink Corp. is active at 27° C.–36° C. Compounds from SICPA Securink Corp. which are active at 22° C.–31° C. include: 128001TC (orange/clear), 1384175TC (rose/clear), 150015TC (green/clear), 148003TC (blue/clear), 17800TC (black/clear), 14001TCBR (blue/red) and 128001TCY (orange/yellow). Compounds from SICPA Securink Corp. which are active at 24° C.–33° C. include: 118000TC (yellow/clear), 128002TC (orange/clear), 138103TC (vermillion/clear), 15002TC (green/clear), 14001TC (blue/clear), 14000TCBR (blue/red) and 128001TCY (orange/yellow). Compounds from SICPA Securink Corp. which are active at 24° C.–33° C. include: 11800TC (yellow/clear), 128002TC (orange/clear), 138103TC (vermillion/clear), 15002TC (green/clear), 14001TC (blue/clear), 14000TCBR (blue/red) and 128002TC (orange/yellow). Compounds from SICPA Securink Corp. which are active at 32° C.–41° C. include: 13001TC (rose/clear), 148002TC (blue/clear), 178001TC (black/clear) and 178002TCBR (blue/red).

Preferred thermochromic compositions are microencapsulated within the backcoat. The microcapsules can be dispersed in a slurry, preferably a neutral aqueous slurry and can be dried to a powder. The encapsulant can vary in composition and includes epoxy resins and polyurea resins. Microencapsulation can be performed by any conventional technique such as interfacial polymerization as described in U.S. Pat. Nos. 3,429,827 and 3,167,602 and in-situ polymerization as described in British Patent No. 989264, coacervation from an aqueous slurry as described in U.S. Pat. No. 2,800,457 and 3,116,206, suspension coating as described in U.S. Pat. No. 3,202,533 and spray drying as described in U.S. Pat. No. 3,016,308. The microcapsules can be of a conventional size but are typically about 30 microns or less.

The thermochromic compositions can be employed in the backcoating formulations in amounts of from 1% to about 50% by weight of the solids within the backcoating formulation. Preferred levels range from about 5% to about 40% by weight of the microencapsulated thermochromic composition, based on the total weight of solids in the backcoating formulation.

Preferably, a special apparatus is not needed to detect the presence of a thermochromic composition and simply rubbing the mark or image with a finger will generate the color shift. Devices which will excite the thermochromic compositions include incandescent light sources, hot air dryers, resistance heaters and other radiant energy sources that emit heat or infrared radiation. Preferred heat sources are those which heat the surface of the thermosensitive compound to a temperature above ambient temperature but less than the temperature of activation of the thermosensitive layer, i.e. about 21° C. to 51° C. The thermochromic compounds typically have a defined temperature range at which the color shift is actuated. For example, thermochromic inks with actuation temperatures in the following ranges are commercially available.

1° to 12° C.
22° to 31° C.
24° to 33° C.
27° to 36° C.
32° to 41° C.

The carrier or vehicle used for the backcoating formulation preferably dries or cures at a temperature below 50° C. If the formulation is for flexographic printing, aqueous based formulations are preferred. The aqueous vehicles which dry by gelation, polymerization or solidification are suitable as are water miscible organic solvents which do not pre-react the thermosensitive layer. The aqueous based carrier may contain a dispersing agent to help solubilize the optically variable compounds within the backcoat formulation. The backcoat formulation preferably has a viscosity which is below 500 cps and preferably in the range of about 5 to 100 cps at 25° C., for flexographic printing. For flexographic printing, a solids content of 40–60 wt % is preferred. For UV cured backcoatings, a tack within the range of 10–20 at 1200 rpm and 90° F. is preferred.

The backcoating may contain an optional pigment or dye which does not interfere with the optical properties of the optically variable ink. Examples may include carbon blacks, cadmium, primrose, cobalt oxide, nickel oxide, etc. When used, the pigment or dye preferably comprises from 0.01 to 10 wt % of the backcoating, based on solids.

Thermal papers which contain security features as a separate image overcoated by the backcoating can be prepared by methods similar to methods with the security feature within the backcoating as described above but with an additional printing step.

The backcoating applied to the thermosensitive recording material may contain more than one security feature provided by a different optically variable compound or by the binder of the backcoating. For example, the fluorescent compounds may be combined with NIRF compounds, thermochromic compounds or photochromic compounds and the binder may provide a water mark or a water repellant image once cured.

The binder component of the backcoating employed in the thermal papers of this invention may be a water repelling agent such as acrylic polymers and copolymers or it may contain a separate water repelling agent such as a silicone resin in an amount of 0.5 to 10 wt % based on total solids. This water repelling agent may provide an additional security for the thermal paper obtained. The water repellant agent is used in amounts efficient to provide a dry image with a surface tension less than 35 dynes preferably between 20 to 30 dynes. Water has a surface tension of 70 dynes. The binder may also dry to provide a pseudo water mark when applied in a pattern.

The backcoating may cover the entire back surface of the base sheet of the thermal paper or it may only cover a portion of the base sheet. Where the backcoating provides a pseudo water mark or a waterproof image, the backcoating does not cover the entire base sheet.

An image is printed on the backcoating by a conventional printing technique such as flexography, lithography, gravure, letter press, relief printing or ink jet printing which does not require the application of heat or high temperatures (less than 65° C.), including U.V., electron beam and infrared cures. The technique employed is preferably identical to the printing method employed to apply the backcoating to the base sheet. Most conventional inks are suitable for providing the image provided they do not contain components which react with the thermosensitive layer. Suitable pigments include carbon blacks, cadmium, primrose, cobalt oxide, nickel oxide, etc. The carrier and binder employed in the ink is preferably identical to that used to apply the backcoating to the ensure compatibility. With such inks, high quality images with high gloss, referred to in the art as "magazine quality" images can be produced.

Without further elaboration is believed that one skilled in the art can using the proceeding description utilize the present invention to its fullest extent. The entire disclosure of all applications, patents, publications, cited above and below are herein incorporated by reference.

EXAMPLES

Example 1

Thermal Paper

Commercially available thermal papers consisting of substrate paper, base coat and an active thermosensitive coat are used. The base coat (40% solids) is comprised as conventional base coat components such as pigments/binders to produce a level surface for the thermosensitive coat. The active coat comprises conventional active coat components such as the dye ODB-2, a bisphenol A co-reactant, a stabilizer and a sensitizer.

Backcoating Containing a Thermochromic Ink

A backcoating formulation which is water based contains a thermochromic ink with thermochromic compounds sold by SIPCA Securink Inc. Corp. of Springfield, Va. The thermochromic compounds respond to color changes at temperatures in the range of 21° C. to 41° C. and a U.V. curable acrylate binder in an amount of 40 to 60 wt %. This backcoating is printed on the side of the thermal paper opposite the thermosensitive layer using a Mark Andy 830 flexopress. The coating comprises a U.V. curable acrylate polymer which is transparent and is controlled to form a three inch wide strip down the center of the paper. The backcoat is cured by exposure to a U.V. lamp for less than 30 seconds.

Security Test

After curing to a solid, a portion of the coating changed color to pink with the application of heat by rubbing the coating with a finger.

Overprinting the Backcoat

Printing over the protective backcoat with a conventional black water based flexographic ink in the form of the "NCR" logo by conventional flexographic techniques provides an image with high definition, high contrast and high adhesion to the backcoating.

The proceeding examples can be repeated with similar success by substituting the generically or specifically described reactants and/or operating conditions of this invention by those described in this application.

In the foregoing description, one skilled in the art can easily ascertain the essential characteristics of this invention without departing from the spirit and the scope above, can make various changes and modifications to the invention to adapt it to various usages and conditions.

What is claimed is:

1. A thermosensitive recording material comprising a base sheet, optionally a base coating, a thermosensitive coating on one surface of said base sheet or the surface of said base coating when present, and a backcoating on the surface of the base sheet opposite the thermosensitive coating, wherein said backcoating incorporates an optically variable thermochromic compound and said backcoating additionally having thereon a flexographic, lithographic, wet-offset printed, gravure, or inkjet printed image.

2. A thermosensitive recording material comprising a base sheet, optionally a base coating, a thermosensitive coating on one surface of said base sheet or the surface of said base coating when present, and a backcoating on the surface of the base sheet opposite the thermosensitive coating, wherein said backcoating incorporates an optically variable thermochromic compound and said backcoating additionally having thereon a flexographic, lithographic, wet-offset printed, gravure, or inkjet printed visible image.

3. A recording material as in claim 2, wherein the optically variable thermochromic compound provides a color change that can be sensed by a naked human eye when heated to a temperature of 21° C. to 51° C.

4. A recording material as in claim 2, wherein the thermochromic compound comprises from 1 wt % to 50 wt % of the backcoating based on a total solids.

5. A recording material as in claim 2, wherein the thermochromic compound is microencapsulated.

6. A recording material as in claim 2, wherein the thermochromic compound changes color when cooled to a temperature below 12° C.

7. A recording material according to claim 2, wherein the backcoating has a thickness of 0.05–2.0 mils.

8. A recording material according to claim 2, wherein the printed image is a visible flexographic printed image.

9. A recording material according to claim 2, wherein the visible printed image comprises a pigment of carbon black, cadmium, primrose, cobalt oxide, or nickel oxide.

10. A recording material according to claim 9, wherein the pigment is carbon black.

11. A recording material according to claim 9, wherein the pigment is cadmium.

12. A recording material according to claim 9, wherein the pigment is primrose.

13. A recording material according to claim 9, wherein the pigment is cobalt oxide.

14. A recording material according to claim 9, wherein the pigment is nickel oxide.

15. A recording material according to claim 1,wherein the printed image is a flexographic printed image.

16. A recording material according to claim 1, wherein the printed image comprises a pigment of carbon black, cadmium, primrose, cobalt oxide, or nickel oxide.

* * * * *